US008894270B2

(12) United States Patent
Ritter

(10) Patent No.: US 8,894,270 B2
(45) Date of Patent: Nov. 25, 2014

(54) MIXING SYSTEM FOR TWO-COMPONENT CARTRIDGE

(76) Inventor: Frank Ritter, Eppishausen/Weiler (DE)

( * ) Notice: Subject to any disclaimer, the term of this patent is extended or adjusted under 35 U.S.C. 154(b) by 767 days.

(21) Appl. No.: 12/802,446

(22) Filed: Jun. 7, 2010

(65) Prior Publication Data

US 2011/0026359 A1 Feb. 3, 2011

(30) Foreign Application Priority Data

Jun. 5, 2009 (DE) ..... 20 2009 007 919 U
Jun. 5, 2009 (EP) ..... 09007452

(51) Int. Cl.

| | |
|---|---|
| ***B01F 5/06*** | (2006.01) |
| ***B01F 13/00*** | (2006.01) |
| ***B65D 81/32*** | (2006.01) |
| *B05C 17/005* | (2006.01) |

(52) U.S. Cl.

CPC ..... *B01F 5/0615* (2013.01); *B01F 13/002* (2013.01); *B01F 13/0027* (2013.01); *B65D 81/325* (2013.01); *B01F 2215/0027* (2013.01); *B01F 2215/0039* (2013.01); *B01F 2215/006* (2013.01); *B05C 17/00553* (2013.01)

USPC ..... 366/163.2; 366/178.1; 366/181.5; 222/145.6

(58) Field of Classification Search

CPC ..... B01F 5/0615
USPC ..... 366/162.3, 178.1, 181.5; 222/145.6
See application file for complete search history.

(56) References Cited

U.S. PATENT DOCUMENTS

| | | | | |
|---|---|---|---|---|
| 5,080,262 | A * | 1/1992 | Herold et al. | 222/135 |
| 5,333,760 | A * | 8/1994 | Simmen | 222/137 |
| 5,429,277 | A * | 7/1995 | Kopp et al. | 222/145.6 |
| 6,132,396 | A * | 10/2000 | Antanavich et al. | 604/82 |
| 2007/0175921 | A1 * | 8/2007 | Keller | 222/137 |
| 2008/0195082 | A1 * | 8/2008 | Pauser et al. | 604/518 |

* cited by examiner

*Primary Examiner* — David Sorkin
(74) *Attorney, Agent, or Firm* — Klaus J. Bach

(57) ABSTRACT

In a mixing system for two-component cartridges having a neck section structure with an inner discharge channel and an outer tubular discharge channel for discharging first and second material components from first and second chambers of the cartridge, the inner discharge channel is provided with pockets extending into the outer discharge channel for dividing the second material flow into second material flow strands and a baffle plate is arranged centrally in front of the inner discharge channel for directing the inner material flow outwardly through the pockets in strands of the inner material component between strands of the outer material component, so that a pre-mixing of the material components occurs already directly at the openings of the discharge channels.

9 Claims, 5 Drawing Sheets

MIXING SYSTEM FOR TWO-COMPONENT CARTRIDGE

BACKGROUND OF THE INVENTION

The invention relates to two-component cartridges for plastic materials such as sealing materials, cements, dental form materials or other materials. Such cartridges comprise two chambers which are often arranged co-axially and are often formed by two tubular bodies which are disposed one in the other at their front areas. A first chamber is formed by the interior space of the inner tubular body and second chamber is formed as an annular chamber between the outer and the inner tubular body. At their rear ends, the two tubular bodies are held in their concentric positions by an annular piston closing the outer annular chamber between the tubular bodies.

The concentric front end areas of the two tubular bodies inserted into one another have discharge openings for the material components disposed in the inner, first chamber and, respectively, the outer second chamber. Up to its use, the two-chamber cartridge is closed by a closing cover, by which it can also be closed during an interruption of its use. For use a mixer is mounted onto the discharge neck of the outer tubular body, which includes a mixing tube in which a number of mixing structures are arranged axially one after the other so as to mix the first material component discharged from the first chamber with the second material component discharged from the second chamber as fast as possible and as homogenously as possible. At the end of the mixing tube, a completely homogenous mixture of the two material components is then supposed to be discharged.

However, it is well-known that such two-component cartridges have problems which, in spite of substantial efforts, have not yet been solved.

One problem is that it must be made sure that the two material components remain completely separated before use that is they must not come into contact with each other in order to prevent a premature reaction between the two material components and their curing or hardening. To this end, it is necessary that, on one hand, the cover completely closes the discharge arrangement of the two tubular bodies completely and tightly and that, in addition, the cover provides for a sealing separation of the discharge opening of the first chamber and that of the second chamber.

A second problem concerns the design of the mixing system which should provide for a homogeneous mixing of the two material components in a mixing tube which is as short as possible and includes as few as possible mixing elements because the required discharge pressure of the two-component cartridge is of course larger the larger the number of subsequent mixing element in the mixing tube is, since each additional mixing element increases the flow resistance. This problem becomes more important the more viscous, the material components to be pressed out of the chambers are.

In order to make the mixer to be threaded onto the discharge neck of the two-component cartridge as short as possible and provide the smallest possible number of mixing elements, the two material components are divided already in the discharge structure into a plurality of strands which enter the mixer and, in this way, accelerate the mixing procedure.

To this end, WO 2005/0925225 A1 discloses a two-component cartridge consisting of two co-axially arranged tubular bodies which, in the area of the concentric discharge passages of the two tubular bodies are formed in such a way that the first material components discharged from the first chamber as well as the second material component discharged from the second chamber are divided into several strands, wherein all material strands form in the discharge neck an annular arrangement in which the material strands of the first material component and those of the second material component are arranged alternately.

The neck section of the inner tubular body, which is disposed in the neck section of the outer tubular body, is provided with an annular arrangement of separate segment-like or cylindrical discharge channels, which is disposed star-like in the discharge neck of the outer tubular body. The circumferential intermediate chambers disposed between the individual discharge channels of the inner annular body which form the discharge passages for the first material component form the discharge passages for the second material component. The circumferentially alternate material strands of the first material component and the second material component then enter the inlet end of the mixer as a parallel strand bundle.

In this known arrangement, it is however disadvantageous that the material strands of the first material component and of the second material component reach the inlet end of the mixer as parallel strands because they are guided over the full length of the neck arrangement through parallel passages so that, without any transverse flow component present in the material strands, mixing is initiated only by the first mixing element of the mixer.

A further disadvantage of the arrangement described resides in the fact that the cover needs to close each of the outlet passages of the discharge neck of the inner tubular body individually and consequently requires the provision of a plug for engaging into each outlet passage. Complete sealing of such an arrangement however is hard to achieve with a cylindrical plug for a cylindrical discharge channel and much more difficult for an annular array of discharge passages. In each case, the closure cap needs to comprise two parts and include a central plug part on which the closure plugs to be inserted into the discharge passages are formed and also a threaded sleeve which can be threaded onto discharge neck of the outer tubular body.

It is the object of the present invention to provide an arrangement which provides for improved mixing of the material components in a relatively short discharge neck of the two-component cartridge.

SUMMARY OF THE INVENTION

In a mixing system for two-component cartridges having a neck section structure with an inner discharge channel and an outer tubular discharge channel for discharging first and second material components from first and second chambers of the cartridge, the inner discharge channel is provided with star-like pockets extending into the outer discharge channel for dividing the second material flow into second material flow strands and a baffle plate is arranged centrally in front of the inner discharge channel for directing the inner material flow outwardly through the pockets in strands of inner material components between the outer material component strands, so that a pre-mixing of the material components occurs already directly at the openings of the discharge channels.

The baffle plate covers the center area over a part corresponding to the cross-section of the cylindrical discharge channel so that the material of the first material component flowing out of the inner space of the first tubular body is forced to flow radially outwardly past the buffer plate and into the pocket-like extensions of the discharge channel. In this way, a plurality of material strands are formed which leave the pocket-like extensions with an axial, radially outwardly diverging, directional flow component.

In a first embodiment of the invention, the baffle plate is formed by a central body which is arranged ahead of the mixing element at the entrance end thereof. The central body may be in the form of a knob and provided with a redirecting tip which points in a direction opposite the material flow and which extends into the discharge end of the outlet channel for the first material component when the mixer is mounted onto the discharge neck. In this embodiment, the cover may have a simple shape. It only needs to have a central plug which extends up to the cylindrical discharge channel of the discharge neck of the inner tubular body for closing the discharge neck. In this way, a reliable seal can be established in a simple manner.

In a second embodiment, the baffle plate is formed integrally with the discharge neck via connecting elements for example ribs or webs which extend radially from the inner wall of the discharge channel. Preferably, the connecting elements are connected to the inner wall of the cylindrical discharge channel so far upstream that, downstream thereof, there is a sufficiently long axial cylindrical or slightly conical discharge channel section in which a hollow plug which is connected to the cover can be accommodated and which acts as a seal that can be moved over the baffle plate.

The second material component which flows out through the annular channel formed between the neck sections of the inner and the outer tubular bodies is also divided into several material strands by flow baffles which are formed by the pocket-like extensions of the exit channel for the first material component which are arranged in circumferential direction alternately with regard to the material strands of the first material components discharged via the pocket-like extensions. With this flow redirection of the second material component by the outer walls of the pocket-like extensions of the inner discharge channels for the first material component, the second material component is redirected sidewardly whereby the material strands of the second material component are subjected to a flow direction component in circumferential direction so that, instantly, a mixing with the material strands of the first material components takes place even before the material strands reach the first mixing element in the mixing tube of the mixer.

The arrangement according to the invention makes a noticeable reduction of the number of the mixing elements in the mixing tube of the mixer possible while still achieving a homogeneous mixing of the two material components and also a substantial reduction of the discharge pressure required. This is based on the following advantages.

Within the neck arrangement, the first material component as well as the second material component are flowing through cross-sectional areas which remain the same up to the point where the inner discharge channel for the first material component widens in the form of the annularly arranged pocket-like extensions which project into the annular flow channel for the second material component. There, overall, the flow cross-section becomes somewhat narrower because of the knob-like central body disposed in the entrance area of the mixer, so that the mixing is intensified because the flow has not only an axial flow direction component but also a circumferential flow direction component. This area of reduced flow cross-section however is axially very short so that the flow resistance induced thereby is quite low. The subsequent mixing process for the two material components then requires only a relatively small number of mixing element in the mixing tube.

The cartridge according to the invention provides for a greater efficiency of mixing of the two material components and it requires only a smaller number of mixing elements in the mixing tube and, consequently, a lower discharge pressure which is particularly advantageous in connection with viscous materials.

Furthermore, with the arrangement according to the invention, the design of the cover is simplified and its sealing capability is substantially improved. Since the inner discharge channel for the first material component is cylindrical and arranged centrally and there is only one such channel the cover may be a single part and have only a central plug which extends into the cylindrical part of the discharge channel for the first material component in order to firmly seal it.

The invention will become more readily apparent from the following description of two exemplary embodiments with reference to the accompanying drawings.

DESCRIPTION OF TWO PARTICULAR EMBODIMENTS

Figure 1:
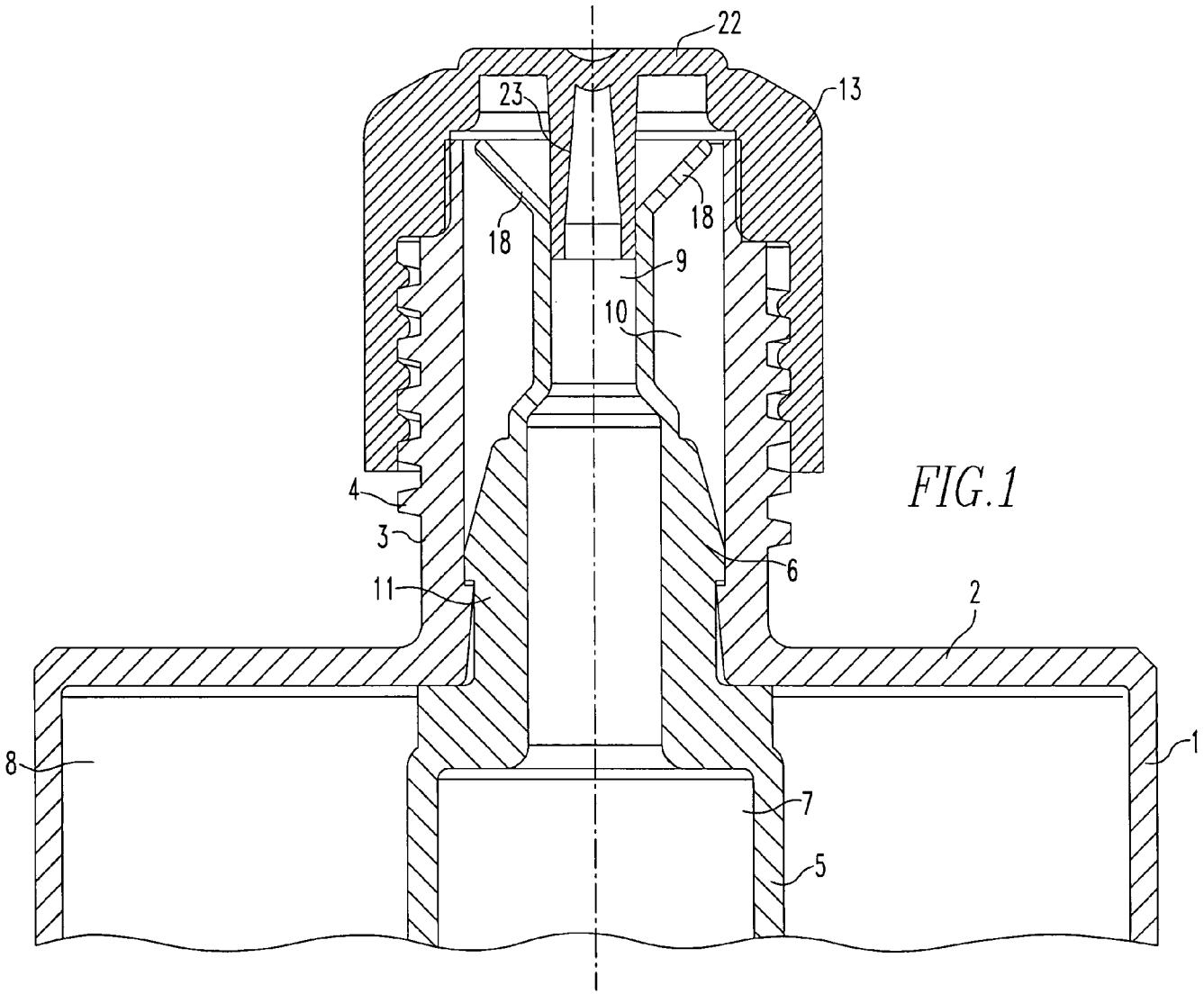
FIG. 1 is a cross-sectional view of the neck area of a two-component cartridge with a mixing system disposed on the neck in accordance with a first embodiment of the invention.
Figure 4:
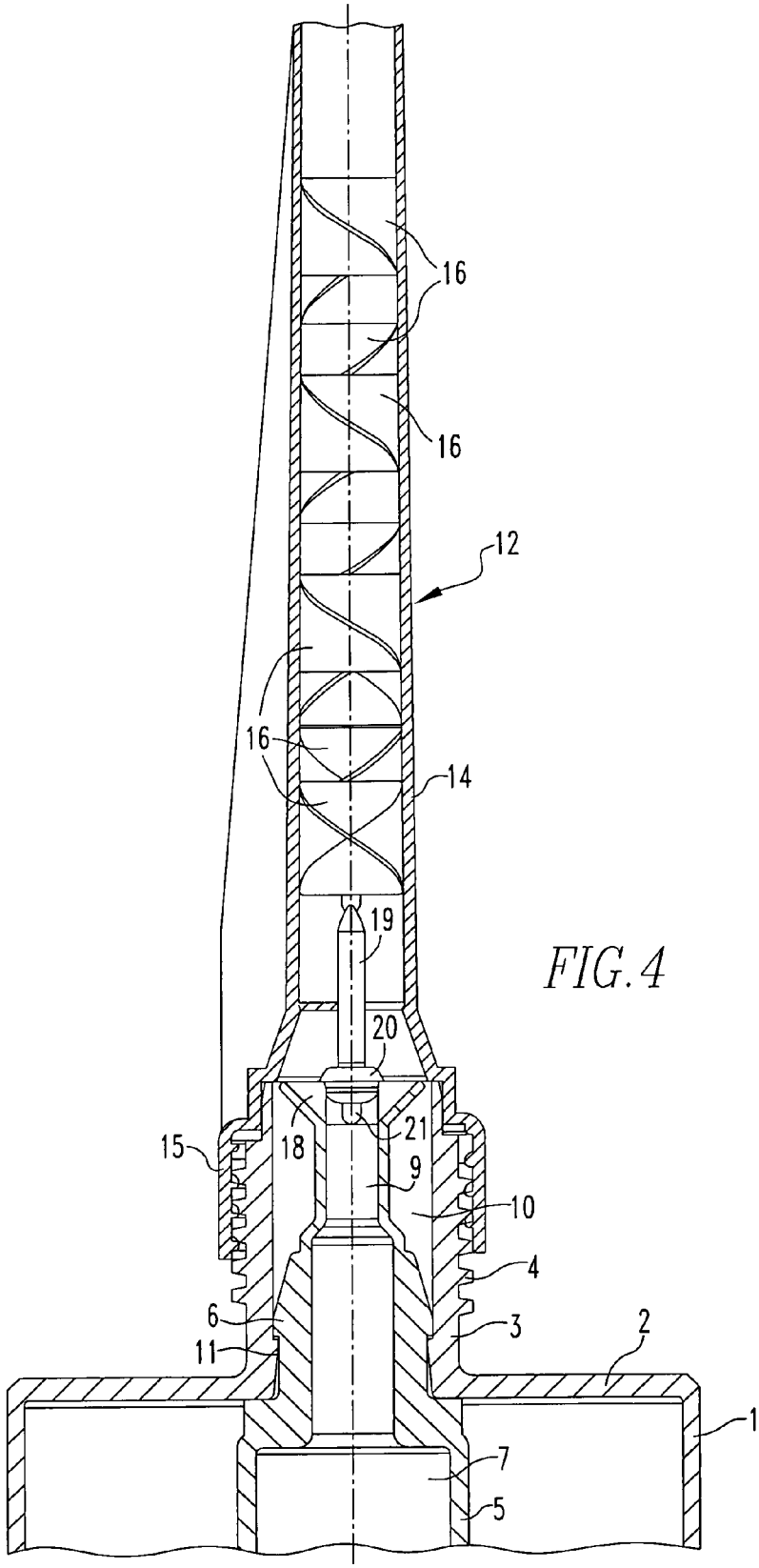
FIG. 4 is an axial cross-sectional view of the neck area of the two component cartridge shown in FIG. 1 with a closing cover disposed thereon.

FIGS. 1 and 4 show a neck area of a two-component cartridge of a first embodiment according to the invention in an axial cross-sectional view. The two-component cartridge according to FIGS. 1 and 2 comprises an outer tubular body 1 with a front end wall 2 and a neck section 3 which is provided with an external thread 4 and an inner tubular body 5 with a neck section 6. The inner tubular body 5 forms an internal first chamber 7 for accommodating a first material component and the outer tubular body 1 defines between itself and the inner tubular body 5 an annular second chamber 8 for accommodating a second material component.

The neck section 6 of the inner tubular body 5 forms a cylindrical discharge channel 9 for the first material component and the neck section 3 of the outer tubular body 1 forms between itself and the neck section 6 of the inner tubular body 5 an annular discharge channel 10 for the second material component. It is noted that the branched section of the neck section 6 of the inner tubular body 5 which is disposed in the rear part of the neck 3 of the outer tubular body 5 has several passages extending axially along its outer surface so as to provide for communication between the annular second chamber 8 and the annular discharge channel 10. These passages are not visible in FIGS. 1 and 4, because the sectional plane extends through the branching ribs 11 of the neck section 6 of the inner tubular body 5.

FIGS. 1 and 4 differ in that in FIG. 4, a mixer 12 is threaded onto the neck portion whereas in FIG. 1*a* a closing cap 13 is threaded onto the neck section.

The mixer 12 comprises a mixing tube 14, which, at its inlet end, is provided with an enlarged diameter threaded sleeve 15, which is threaded onto the external thread 4 of the neck section 3 of the outer tubular body 1. The mixing tube 14 is provided with a number of axially adjacent mixing elements 16 which are known per se and which tilt and divide the material strands again and again so as to provide for a through mixing of the two material components.

Figure 2:
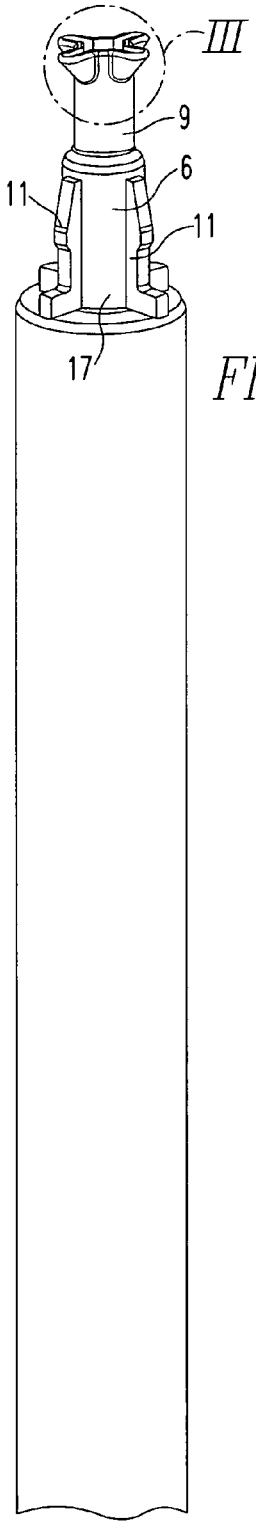
FIG. 2 is a perspective view of an inner tubular body of the two-component cartridge including the neck area shown in FIG. 1.

FIG. 2 is a perspective view of the front end area of the inner tubular body 5 including the neck section 6. In this figure, also the branched engagement ribs 11 as well as the passages 17 disposed in circumferentially spaced relationship between the second chamber 8 and the annular discharge channel 10 are visible.

Figure 3:
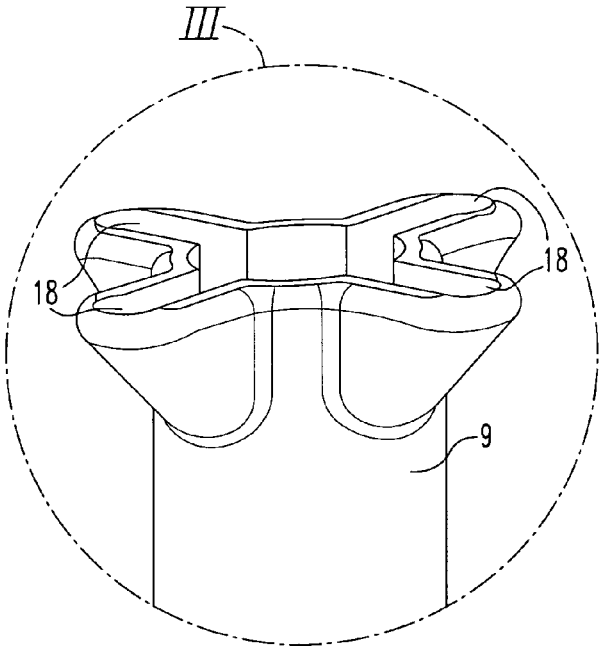
FIG. 3 is an enlarged perspective view of the feature III of FIG. 2.

As shown in FIG. 2 and in FIG. 3, which shows the part III of FIG. 2 in an enlarged representation, the end of the cylindrical discharge channel 9 of the neck section 6 of the inner tubular body 5 becomes wider toward its exit end by providing four cross-shaped or star-shaped pocket-like extension 18 which diverge radially outwardly and as shown in the cross-sectional view of FIGS. 1 and 4 extend into the discharge area of the annular discharge channel 10 between the neck sections 3 and 6 of the outer tubular body 1 and the inner tubular body 5.

As shown in FIG. 4, the mixer insert comprising the mixing elements 16 of the mixer 12 has, at its lower that is its inlet end, a central plug 19 with a knob-shaped end 20 which forms a baffle plate when the mixer 12 is disposed on the neck section 3, 6 and extends into the discharge end of the inner cylindrical discharge channel 9 to block the center area. Then the first material component being discharged from the discharge channel 9 is divided into four material strands flowing outwardly at an inclined angle axially and radially through the pocket-like extensions 18. As shown the central body 20 preferably has an upstream directed deflection tip 21 which, as shown, has the form of an about cylindrical and rounded plug which may however also be cone-shaped.

The second material component discharged via the annular discharge channel 10 is then also divided via the pocket-like extensions 18 of the discharge channel 9 into several material strands which are received between the material strands of the first material component and are provided with a transverse directional flow component by a deflection in circumferential direction applied by the pocket-like extensions 18 which enhances an instant mixing with the material strands of the first material component.

FIG. 1 shows the neck-side end area of the two component cartridge with the closing cap 13 threaded onto the cartridge. The closing cap 13 is a single-piece component and is provided at its front wall 22 with an integrally formed hollow plug member 23 which extends inwardly and has an axial length so dimensioned that, upon threading the closing cap 13 onto the outer thread 4 of the neck section 3 of the outer tubular body 1, it projects into the cylindrical part of the discharge channel 9 of the neck section 6 of the inner tubular body 5 and sealingly closes the inner tubular body 5.

In the first embodiment of the invention shown in FIGS. 1-4, the baffle plate, which is formed by the central body at the entrance end of the mixer, is formed separately from the neck section arrangement 3, 6 and becomes effective in connection with the neck section 3 only upon installation of the mixer.

Figure 5:
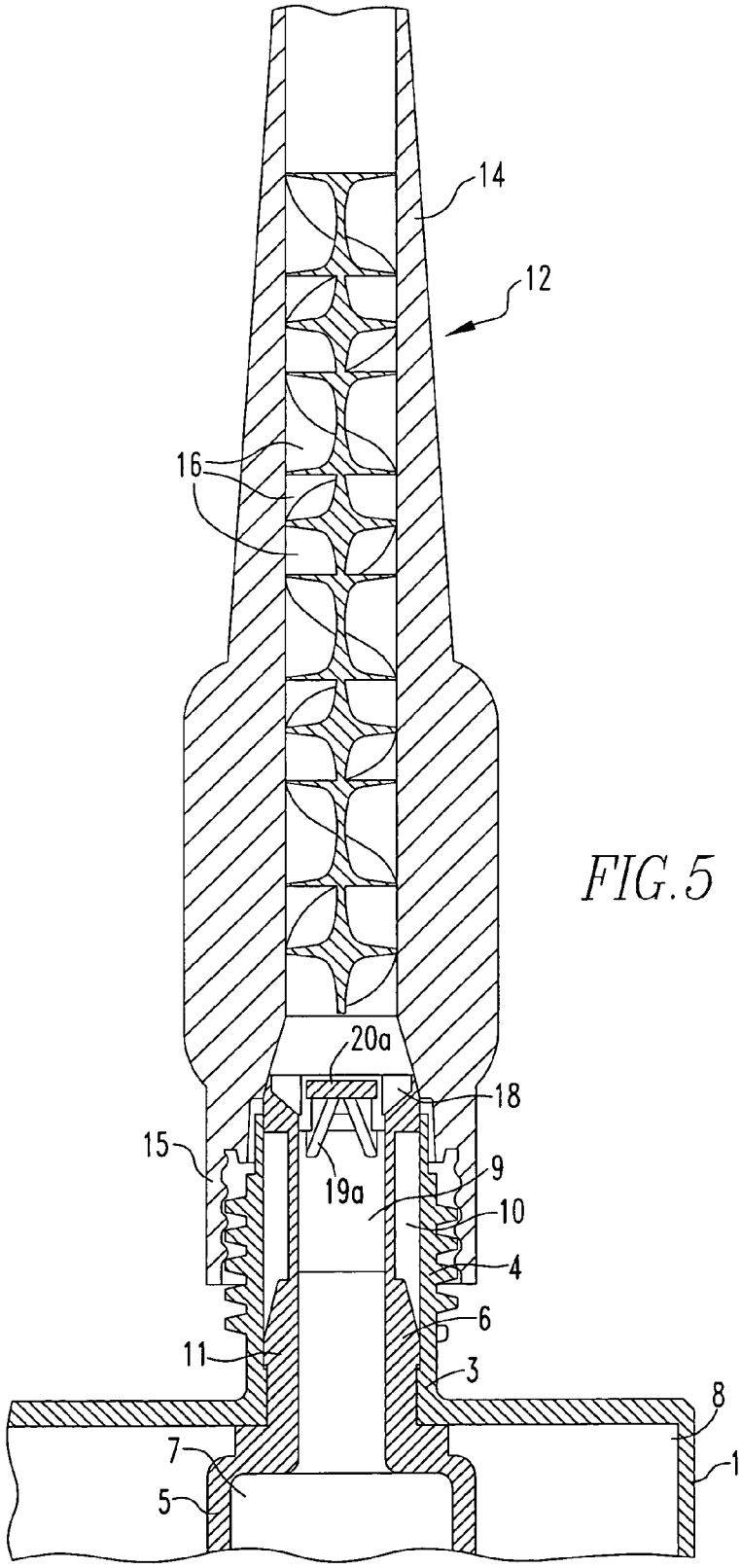
FIG. 5 is a cross-sectional view of the neck area of a two-component cartridge and a mixer disposed thereon including a mixing system according to a second embodiment of the invention.
Figure 6:
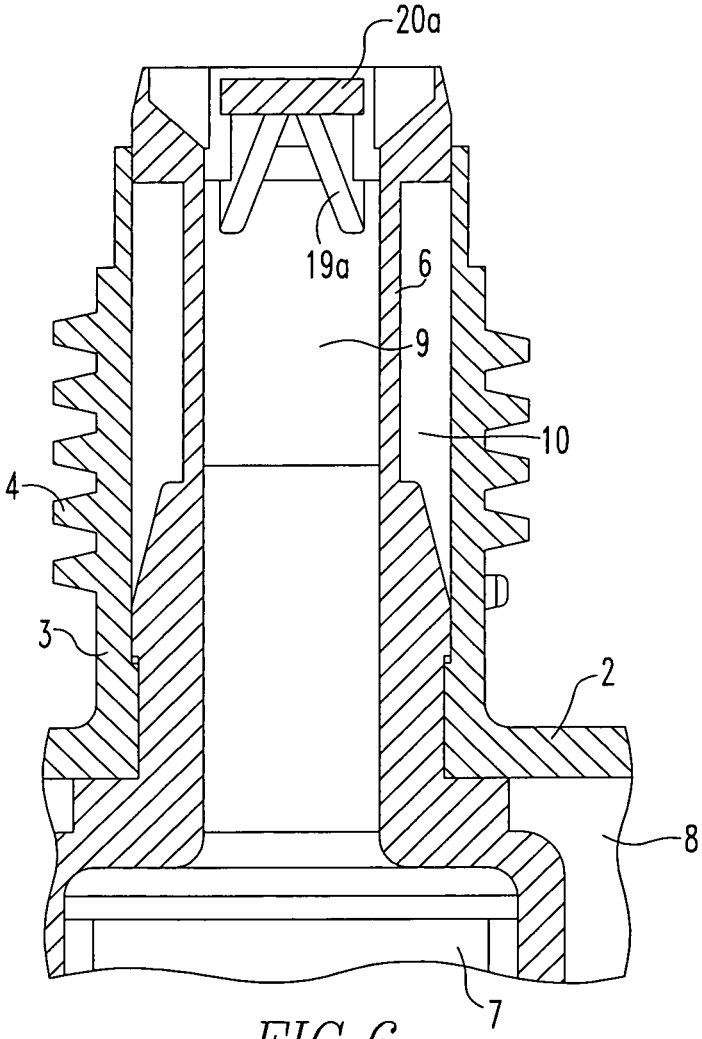
FIG. 6 is an axial cross-sectional view of part of the two component cartridge according to FIG. 5 with a mixer disposed thereon.

FIGS. 5 and 6 show a second embodiment of the invention which differs from the first embodiment in that the baffle plate is formed as part of the neck section.

In FIGS. 4 and 5, the same or corresponding elements are designated by the same reference numerals as used in FIGS. 1 -4 and corresponding but modified elements are provided with the same reference numerals provided however with an adjunct.

FIG. 5 shows the neck-side end area of a two-component cartridge with an outer tubular body 1 and an inner tubular body 5 with a mixer disposed thereon, whereas FIG. 6 shows the end area without mixer. The outer tubular body 1 has a front end wall 2 and a neck section 3 which is provided with an external thread 4, and the inner tubular body 5 has a neck section 6 like the arrangement according to FIGS. 1 to 4. This is also true for the arrangement of the neck section 6 of the inner tubular body 5 which forms a cylindrical discharge channel 9 for the first material component. At the discharge end, the cylindrical discharge channel 9 is expanded by cross- or star-like pocket extensions 18 which diverge radially outwardly into the discharge area of the annular discharge channel 10 between the neck sections 3 and 6 of the outer tubular body 1 and the inner tubular body 5.

The difference between the embodiment of FIG. 5 and that of FIGS. 1-4 resides in the fact that the plug 19 with the central body 20 forming the baffle body 20 arranged at the entrance end of the mixer 12 of FIG. 4 is omitted.

Instead, in the embodiment of FIGS. 5 and 6, a baffle plate 20*a* is arranged in the discharge area of the inner neck section 6 and supported via webs 19*a* on the inner wall of the neck section 6.

However, the webs 19*a* are connected to the inner wall of the suck section 6 only at a certain axial distance from the end of the cylindrical part of the discharge channel 9 upstream of the location of the baffle plate 20*a*. Downstream of the connection location of the webs 19*a* a short cylindrical end section 9*a* of the discharge channel 9 is established into which a cylindrical annular sleeve formed on a closure cap can extend for sealingly closing the discharge channel 9. As shown in the figures, the diameter of the baffle plate 20*a* is somewhat smaller than the cross-section of the cylinder discharge channel 9 so that such a cylindrical annular sleeve formed on a cover can be moved over the baffle plate 20*a* and, in this way, in cooperation with the end section 9*a* of the discharge channel, sealingly closes the discharge channel 9.

A further modification which corresponds essentially to the embodiment according to FIGS. 5 and 6 would be a snap on connection between the baffle plate 20*a* of the inner neck section 6 by means of correspondingly formed connecting webs 19*a* and counter elements arranged at the internal wall of the neck section 6, for example, in the form of a radial step or rib. The baffle plate 20*a* with the connecting webs 19*a* may then be manufactured separately and subsequently be inserted into the end of the discharge channel 9 and locked in position. While such an embodiment would basically be feasible at this point, the single piece arrangement as shown in FIGS. 5 and 6 is favored because it can be realized easily with available manufacturing procedures and there is no danger that, for example because of a faulty snap-in engagement, the baffle plate is pressed out of its engagement seat by the pressure of the material being discharged via the discharge channel 9 on the baffle plate.

What is claimed is:

1. A mixing system for a two-component cartridge having first and second chambers (7, 8) for accommodating plastic materials, said system comprising a neck structure (3, 6) of said two-component cartridge and a mixer (12), the neck structure including an inner neck section (6) and an outer neck section (3), the inner neck section (6) forming an inner essentially cylindrical discharge channel (9) for a first material dispersed in the first chamber (7) and the outer neck section (3) forming between itself and the inner neck section (6) an annular outer discharge channel (10) for a second material component disposed in the second chamber (8), and the mixer (12) having a mixing tube (14) to be mounted onto the neck section structure (3, 6) and including a plurality of mixing elements (16) arranged axially adjacent one another in the mixing tube (14), said neck section structure (3, 6) including means (18) for dividing the material flows of the first material component and of the second material component so as to form a number of annularly alternately arranged axial strands of the first and the second material components, said inner discharge channel (9) including as dividing means (18) at its discharge end star-like arranged pocket-shaped extensions (18) projecting into the annular outer discharge channel (10), and the inner discharge channel (9) including a baffle plate (20, 20*a*) which, with the mixer (12) installed, is arranged in the area of the discharge opening of the inner discharge channel (9) for directing the first material flow outwardly through the pocket-shaped extensions (18).

2. The mixing system according to claim 1, wherein the baffle plate (20) is formed by a central body arranged at the inlet end of the mixer (12) and which, when the mixer is installed on the neck section structure (3, 4) blocks the center area of the inner discharge channel (9).

3. The mixing system according to claim 2, wherein the central body forming the baffle plate (20) is connected via a central plug (19) to the first mixing element (16) of the plurality of mixing elements disposed in the mixing tube (14).

4. The mixing system according to claim 2, wherein the central body forming the baffle plate (20) is in the shape of a knob.

5. The mixing system according to claim 1, wherein the baffle plate (20*a*) is connected to the inner, neck section (6).

6. The mixing system according to claim 5, wherein the baffle plate (20*a*) is connected to the inner wall of the inner discharge channel (9) by means of support elements (19*a*) and is formed integrally with the inner neck section.

7. The mixing system according to claim 5, wherein the baffle plate (20*a*) is engaged. with the inner wall of the inner discharge channel (9) via support elements extending into the inner discharge channel and are locked therein in place.

8. The mixing system according to claim 6, wherein the support elements (19*a*) of the baffle plate (20*a*) are connected to the inner wall of the inner discharge channel (9) at a predetermined. distance upstream of the discharge end of the about cylindrical inner discharge channel (9) and the outer diameter of the baffle plate (20*a*) is smaller than the diameter of the inner discharge channel (9).

9. The mixing system according to claim 1, wherein the pocket-like extensions (18) extend radially and also axially into the annular outer discharge channel (10) for directing strands of the first material between strands of the second material formed by the outer surface of the pocket-like extensions (18).

* * * * *